US006473670B1

(12) United States Patent
Huhtelin

(10) Patent No.: US 6,473,670 B1
(45) Date of Patent: Oct. 29, 2002

(54) METHOD AND APPARATUS FOR EXECUTING GRADE CHANGE IN PAPER MACHINE GRADE

(75) Inventor: Taisto Huhtelin, Tampere (FI)

(73) Assignee: Metso Paper Automation Oy, Tampere (FI)

( * ) Notice: Subject to any disclaimer, the term of this patent is extended or adjusted under 35 U.S.C. 154(b) by 0 days.

(21) Appl. No.: 09/483,418

(22) Filed: Jan. 14, 2000

Related U.S. Application Data

(63) Continuation of application No. PCT/FI98/00585, filed on Jul. 10, 1998.

(30) Foreign Application Priority Data

Jul. 14, 1997 (FI) ..... 972989

(51) Int. Cl.[7] ..... G05B 15/02; D21F 1/08
(52) U.S. Cl. ..... 700/128; 700/127
(58) Field of Search ..... 700/28, 29, 30, 700/127–129; 162/100–232

(56) References Cited

U.S. PATENT DOCUMENTS

| | | | | |
|---|---|---|---|---|
| 3,687,802 A | * | 8/1972 | Rummel et al. | 162/198 |
| 3,886,036 A | * | 5/1975 | Dahlin | 162/198 |
| 4,160,004 A | * | 7/1979 | Curry et al. | 264/120 |
| 4,224,513 A | * | 9/1980 | Casey et al. | 250/216 |

FOREIGN PATENT DOCUMENTS

| | | |
|---|---|---|
| GB | 1360442 | 4/1971 |
| JP | 60-71793 A | 4/1985 |

OTHER PUBLICATIONS

Copy of Finnish Office Action; Appl. No. 972989; Dated Mar. 24, 1998.
Paavo Viitamäki & Olli Ventä Ja Heikki Välisuo; Tietojärjestelmätuettu Lajinvaihto Prosessiteollisuudessa; Automaatio 95, Automaatiopäivät–Robotiikkapäivät 3; May 5, 1995; pp. 355–357.
David McQuillin & Phillip W. Huizinga; James River Cuts Grade Change Time With Automated, Predictive Controls, Pulp & Paper, Sep. 1994, pp. 143–146.
Paavo Viitamäki; Lajinvaihto Paperikoneella; Automaatio 93, Automaatiopäivät 11; May 13, 1993; pp. 241–243.
Copy of Finnish Office Action; Appl. No. 972989; Dated Mar. 12, 2001.
Heikki Välisuo, Olli Ventä, Arto Smolander, Paavo Viitamäki, Ismo Laukkanen, Anne Niemenmaa and Kaj Juslin; Managing Grade Changes In Paper Production By Using Modern Process Control Techniques; Automation Technology Review 1996, Nov. 30, 1996; pp. 16–30.

* cited by examiner

*Primary Examiner*—Leo Picard
*Assistant Examiner*—Alexander Kosowski
(74) *Attorney, Agent, or Firm*—Alston & Bird, LLP

(57) ABSTRACT

The invention relates to a method and an apparatus for executing a grade change in a paper machine, in which method a grade change is executed by determining, in advance, target ramps for different process variables, which are ramped according to said ramps during the grade change. Data about the grade changes already executed is collected, whereafter data about successful grade changes is selected and the grade change models to be used are determined on the basis of this data, and the target ramps are determined by means of these grade change models.

9 Claims, 4 Drawing Sheets

METHOD AND APPARATUS FOR EXECUTING GRADE CHANGE IN PAPER MACHINE GRADE

CROSS-REFERENCE TO RELATED APPLICATIONS

This application is a continuation of pending PCT International Application PCT/FI98/00585, filed Jul. 10, 1998, designating inter alia the United States.

FIELD OF THE INVENTION

The invention relates to a method for executing a grade change in a paper machine, in which method target ramps are determined in advance for controlled variables of the process, which are ramped according to said target ramps during the grade change.

Further, the invention relates to an apparatus for executing a grade change in a paper machine, the apparatus comprising control means that contain target ramps, which have been defined in advance for the controlled variables of the process and according to which the variables are ramped during the grade change.

BACKGROUND OF THE INVENTION

A grade change in a paper machine means changing the paper grade currently produced into another grade of paper. A grade change is carried out by simultaneously changing different process variables, such as basis weight and moisture, to correspond to the target values of the new paper grade. The change is executed while the paper web is running through the machine. The product produced during a grade change usually ends up as broke and therefore grade changes should be as fast as possible. Due to the complicated nature of the process and the interdependence of the different variables, a grade change is very difficult to execute. The runs of different paper grades to be produced are often rather small, which results in frequent grade changes, and on the other hand the running speeds of paper machines are high and therefore the time used for a grade change should be minimized. Grade changes should not produce breaks in the paper web either.

U.S. Pat. No. 3,886,036 discloses an open loop grade change solution, wherein target ramps are determined in advance for the controlled variables of the process, such as machine speed, stock flow, headbox pressure and steam pressure, and the grade change is executed according to these target ramps. Determining the target ramps requires the development of process models. Further, the open loop arrangement is criticized in the US patent since in practice the process models depend on assumptions made during the modelling, which means that when the conditions change slightly the assumptions are no longer valid and the grade change is not very successful. Another problem set forth in the patent is for example that a slight change in the properties of the pulp causes such an alteration in the conditions that the grade change model does not work well anymore. As a solution to these problems, the US patent discloses a closed loop grade change arrangement, which suggests combining the control loops for basis weight and moisture such that adjusting one variable does not cause a great change in the other variable. According to the U.S. patent, such a grade change can only be carried out when the following restrictions apply:

1) the steam pressure is kept constant during the grade change 2) the machine speed is calculated by the control loops, i.e. in practice the only variable altered during a grade change is the basis weight. Such a grade change is called dryer limited grade change. A change in the basis weight is also connected to cause a corresponding change in the slice of the headbox. The machine speed is adjusted to maintain the moisture at a desired value. Such closed loop grade changes do not operate smoothly, which means that a grade change takes too much time.

Japanese patent publication 6,071,793 discloses an apparatus for controlling the changing of a paper grade in a paper machine, in which apparatus the speeds of different parts of the paper machine are controlled by altering the draw with respect to a change in the basis weight. The optimum model is calculated and it is optimized during the grade change. It is not disclosed how the other process variables are taken into account. The apparatus according to the Japanese patent publication might make it possible to optimise the draw, but this arrangement is not good enough considering the speed and overall control of the grade change.

SUMMARY OF THE INVENTION

The purpose of the present invention is to provide a method and an apparatus which provide a fast and controlled grade change in a paper machine.

The method according to the invention is characterized by collecting data about the grade changes already executed and thereafter determining grade change models by selecting the data about successful grade changes and by determining the target ramps by means of the grade change models.

Further, the apparatus according to the invention is characterized in that the target ramps supplied to the control means have been determined by means of grade change models defined on the basis of successful grade changes.

The basic idea of the invention is that a grade change is executed by determining target ramps in advance for the controlled variables of the process by means of grade change models determined for the process output variables, and the control variables are ramped during the grade change in accordance with the determined target ramps. Further, it is essential that the grade change models are determined by collecting data about the grade changes that have already been executed and by thereafter using as grade change models the grade change models determined on the basis of the successful grade changes. Individual grade change models are defined for different types of changes, for example an increase or decrease in the basis weight. Further, the idea of a preferred embodiment is that during a grade change the target moisture is predicted through modelling by taking into account the effective production rate and the effective steam pressure and by comparing the estimate to the moisture measured, whereupon the feedback provides a disturbance variable which is monitored throughout the grade change, which means that external disturbance should be eliminated during the grade change or the ramps are corrected by the disturbance detected.

The invention has the advantage that a grade change can be executed rapidly and the process is well controlled during the grade change so that there are for example very few breaks. By estimating the moisture it is possible to determine the grade change model more accurately and to eliminate, if necessary, changes in the original values. The arrangement according to the invention enables the activation of a grade change before the run of the previous grade of paper has been completed and ensures that the paper moisture does not change too much during the grade change and does not thus prevent the operation of the subsequent process steps. The invention provides a very rapid and accurately controlled grade change that is executed by means of simple grade change models, which means that the modelling and tuning is also relatively easy.

BRIEF DESCRIPTION OF THE DRAWINGS

The invention is described in greater detail in the attached drawings in which.

DETAILED DESCRIPTION OF THE DRAWINGS

Figure 1:
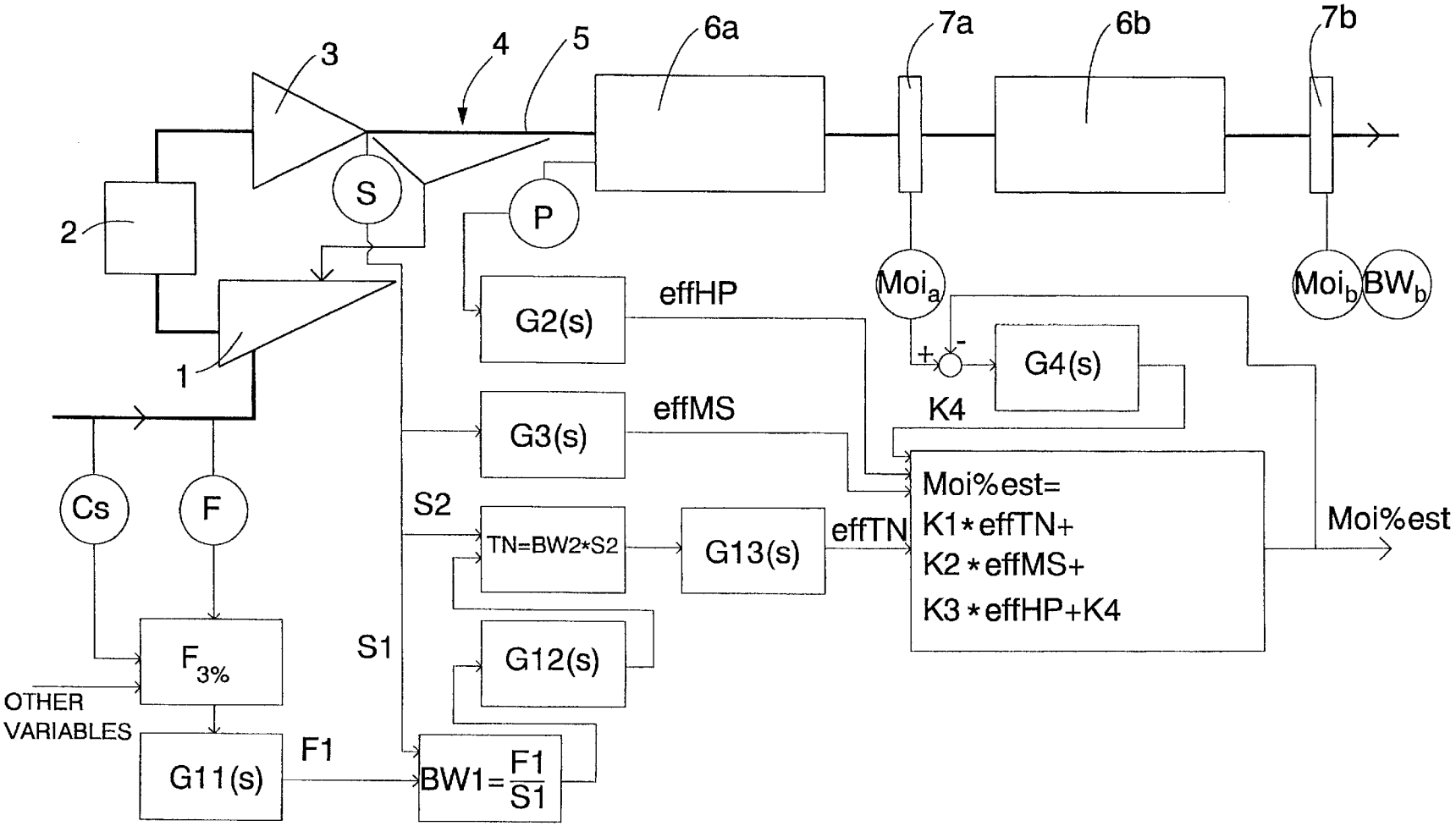
FIG. 1 is a schematic diagram of a grade change model according to the invention for predicting moisture.

FIG. 1 shows a grade change model according to the invention. The grade change model is an application of dynamic models and particularly of state models wherein the grade change model used is intended to describe the dynamic behaviour of the process sufficiently accurately during the grade change. Thick stock is supplied to a paper machine via a wire pit silo 1. In the wire pit silo 1, water is mixed into the thick stock to adjust the consistency to a suitable level. Before the stock is supplied to a headbox 3, coarse particles and air are removed therefrom with cleaning means 2. From the headbox 3 the stock is supplied into a former section 4, where a fibre web 5 is formed from the stock. The fibre web 5 is dried in a dryer section 6*a* followed by a first scanner 7*a* for measuring for example the moisture $Moi_a$ of the fibre web 5. There may also be a second dryer section 6*b* and a second scanner 7*b*. A paper machine, which in the present application refers to both paper and board machines, also comprises for example a press section and a reeler, and it may also comprise e.g. size presses or a calender, which are not shown in the attached figure for the sake of clarity. Furthermore, the operation of a paper machine is known per se for a person skilled in the art and therefore it will not be described in greater detail in this connection.

In a grade change model according to the invention for estimating the moisture, the input variable is the stock flow F. Theoretically this is the flow of the dry matter of the stock, but if the consistency Cs is known and constant, it is also possible to use the measured stock flow F or the flow that has been compensated by the measured consistency. The stock flow F can be converted for example through calculation into a 3-percent value F3%. Transfer function G11(s) is used to determine from the stock flow F the fully retentive 3-percent flow F1 that flows from the headbox 3 to the wire. Alternatively, the modelling can be carried out until the end of the press section, in which case the grade change model is not as accurate as possible. In most cases transfer function G11(s) can be described sufficiently accurately with equation 1

$$G(s) = \frac{Y(s)}{X(s)} = \frac{Ke^{-Tds}}{1+\tau s}, \tag{1}$$

When G(s) is the process transfer function on s domain, Y(s) is the Laplace transform of the process output, X(s) is the Laplace transform of the process input, K is the process gain, Td is the process dead time and τ is the process time constant. According to equation 1, process transfer function G(s) contains data on how the different frequency components of the input X(s) change as they pass through the process. Correspondingly, transfer function G(s) can be calculated when the output Y(s) and the input X(s) are known. According to the invention, the controlled variables used in a grade change are ramps, so that the frequency components of the input in the model according to equation 1 can be adjusted by means of the shape of the ramp. When a typical process model is being modelled, an input with a more varied frequency band is used. Such modelling in turn results in more complicated models that are typically required in running certain grades when using feedback controls. In the case of transfer function G11(s), the process gain K=1 if the removal of mass for example in centrifugal cleaners is not taken into account. The dead time Td describes the propagation time of the material through the process, and the time constant τ describes the mixing in the process with a model comprising one ideal mixer. It is evident for a person skilled in the art how G(s), Y(s) and X(s) are converted into a frequency domain and a time domain by using the Laplace and Fourier transformations and feedback transformations. The correlations between the process input and output can be described by several different techniques in a manner known per se. Since the essential feature in the present invention is the process grade change model, i.e. the inputs and outputs of the process step and the correlations between them, the present application only utilizes transfer function models (Laplace transform, level s) to describe the structure of a grade change model. One and the same correlation described by a grade change model can be presented with several different mapping methods, if necessary.

If grade change models with better dynamics are to be obtained in connection with transfer function G11(s), equation 2 is used $$G(s) = \frac{Y(s)}{X(s)} = \frac{Ke^{-Tds}}{(1+\tau s)(1+\tau s)}, \tag{2}$$

since it takes better into account the mixing in several stages. Correspondingly, if the purpose is to model in greater detail the effect of the retention when using poorly retentive substances, transfer function G11(s) can be described by equation 3

$$G(s) = \frac{Y(s)}{X(s)} = \frac{Ke^{-Tds}}{1+\tau s} + \frac{Ke^{-Tds}}{1+\tau s}, \tag{3}$$

wherein the first part of the transfer function typically describes the portion remaining directly on the wire and the second part of the function describes the inadequately retentive flow passing once or several times through the wire pit silo 1.

In connection with the stock flow it is also possible to take into account the effect of other variables, such as variation in the filler and/or the flow in the other headboxes if the apparatus comprises several headboxes.

The machine speed S is measured, and the speed of the former section, i.e. the speed with which the fibre web 5 is formed on the wire, is used as machine speed. Dividing the flow F1 passing onto the wire by the current machine speed S1 provides the calculated basis weight BW1 on the lip.

Transfer function G12(s) describes the transport delay of the material from the headbox 3 to the calculated centre or to the end of the dryer section 6*a*, depending on the accuracy desired. Transfer function G12(s) thus provides the basis weight BW2. Transfer function G12(s) is described by equation 4

$$G(s)=Ke^{-Tds}.\text{tm} \quad (4)$$

Process gain K of this section is typically 1 if the grade change model does not take into account the stretching of the web and its shrinkage caused by drying. The propagation time depends on the wire speed or it is constant and describes the average speed of the web. There is naturally no mixing time constant in such a transport process. An instantaneous production rate TN can be obtained by multiplying the basis weight BW2 determined above by the current machine speed S2.

However, the instantaneous production rate TN for drying does not describe sufficiently the need for drying since the heat content on the dryer section 6*a* can be utilized during a grade change. Further, water is removed from the paper during the entire drying stage and therefore it must be noted that water is removed specifically from the remaining water content and as the moisture decreases the removal of water becomes slower. Effective production rate effTN describes the amount of discharged water in the constant initial moisture. The effective production rate effTN is obtained from the instantaneous production rate TN by means of transfer function G13(s). Transfer function G13(s) describes the effect of the material flow passing through the dryer section 6*a* and the variation therein on the drying process. This means changes for example in the surface temperatures of the cylinders and in the moisture of the felt during grade changes. Transfer function G13(s) is typically as shown either in equation 1 or 2, which means that at this stage the dead time is almost non-existent and the mixing time constant is rather long.

Steam pressure P of the drying stage is measured from the dryer section 6*a*. The data required is the drying energy introduced into the drying process. The steam pressure P describes the amount of heat supplied to the drying process. If desired, the steam consumption can be used to describe the drying energy supplied to the process. In new drying arrangements it is possible to use several different dryer sections and therefore each section must be provided with its own grade change model since different drying methods have different dynamics. Effective steam pressure effHP describes the amount of heat supplied to the drying process. The effective steam pressure effHP is obtained from the steam pressure P by means of transfer function G2(s). Transfer function G2(s) is as shown in either equation 1 or 2, depending on the drying arrangement used. If there are several dryer sections, each section must be provided with an individual grade change model and the effect of each variable on the drying must be cumulated. In such a case the modelling is naturally more difficult, but it is also possible to execute grade changes preferably such that only one dryer section is used in the grade change control and the other sections are kept in a steady state.

Since the machine speed S changes during the entire drying stage, it is necessary to use a machine speed describing the drying time, e.g. the average rate of drying. Effective machine speed effMS is obtained by means of transfer function G3(s). This concerns the effect of tension and other corresponding alterations related to a change of speed on the drying process itself or on the heat transfer. It is possible to use for modelling the time the paper remains in the dryer section or the corresponding average speed or transfer function G3(s) according to equation 3. If the changes in speed are small or otherwise inconsequential, the effective machine speed effMS can be ignored.

Changes occurring in the given values during the grade change as well as unknown variables, such as moisture after the press section, changes in the stock, freeness and the ash content etc, and their effect on the estimated moisture Moi%est are taken into account by means of one state variable, namely effective press moisture K4. This means that variations occurring during a grade change are seen as calculation errors in the grade change model since they are outside the scope of modelling. The modelling of the effective press moisture K4 can be executed for example such that the moisture value obtained from the previous measurement cycle is compared to the moisture value provided by the grade change model, and the effect of the error detected in the model is corrected to the effective press moisture K4 by means of transfer function G4(s). Since the paper moisture during a grade change can be measured, transfer function G4 is as shown in equation 5

$$G(s)=Ks^{-1}. \quad (5)$$

In this case the difference between the measurement and the grade change model is integrated to obtain a correction signal, namely the effective press moisture K4. If no feedback data, which means the measured moisture, is available during the grade change, variable K4 is not updated but it is kept constant either in the value calculated last or in the value obtained through modelling.

A grade change model estimating the moisture has the form Moi%est=K1*effTN+K2*effMS+K3*effHP+K4. Constants K1, K2 and K3 are process gains modelled from previous corresponding grade changes. Process gains K1, K2 and K3 are only modelled by means of successful grade changes that have been fast enough and that have rapidly reached a steady state. Furthermore, grade changes are grouped according to the grade change to be executed, which means that models are determined according to whether for example the basis weight and the moisture are to be increased or decreased and so forth. Successful grade changes are then modelled and a database of the successful grade changes is collected.

Successful ramping is ensured by means of a grade change display showing the planned grade change as a function of time as regards both the input and the output variables. Disturbance variable K4 is monitored during the grade change and external interference is preferably eliminated or the ramp values are corrected by the interference detected.

The different controlled variables of the process are guided to their new values most preferably by means of linear ramps, in which case the adjustment and the execution of the grade change are simple.

When a grade change is started, the moisture value typically changes and it is set at a predetermined level after the grade change. Usually, when the moisture reaches the desired value, the grade change has been executed successfully, after which the normal controls of the paper machine are switched on to control the production in a normal situation after the grade change.

The moisture $\text{Moi}_b$ that is to be measured after the second dryer section 6*b* or the secondary dryer section, measured for example from the second measuring beam 7*b*, can also be estimated according to the above-described principle, except that the moisture $\text{MOi}_a$ measured from the first measuring beam is also available. It is also possible to measure the basis weight $\text{BW}_b$ from the second measuring beam 7*b*.

Figure 2:
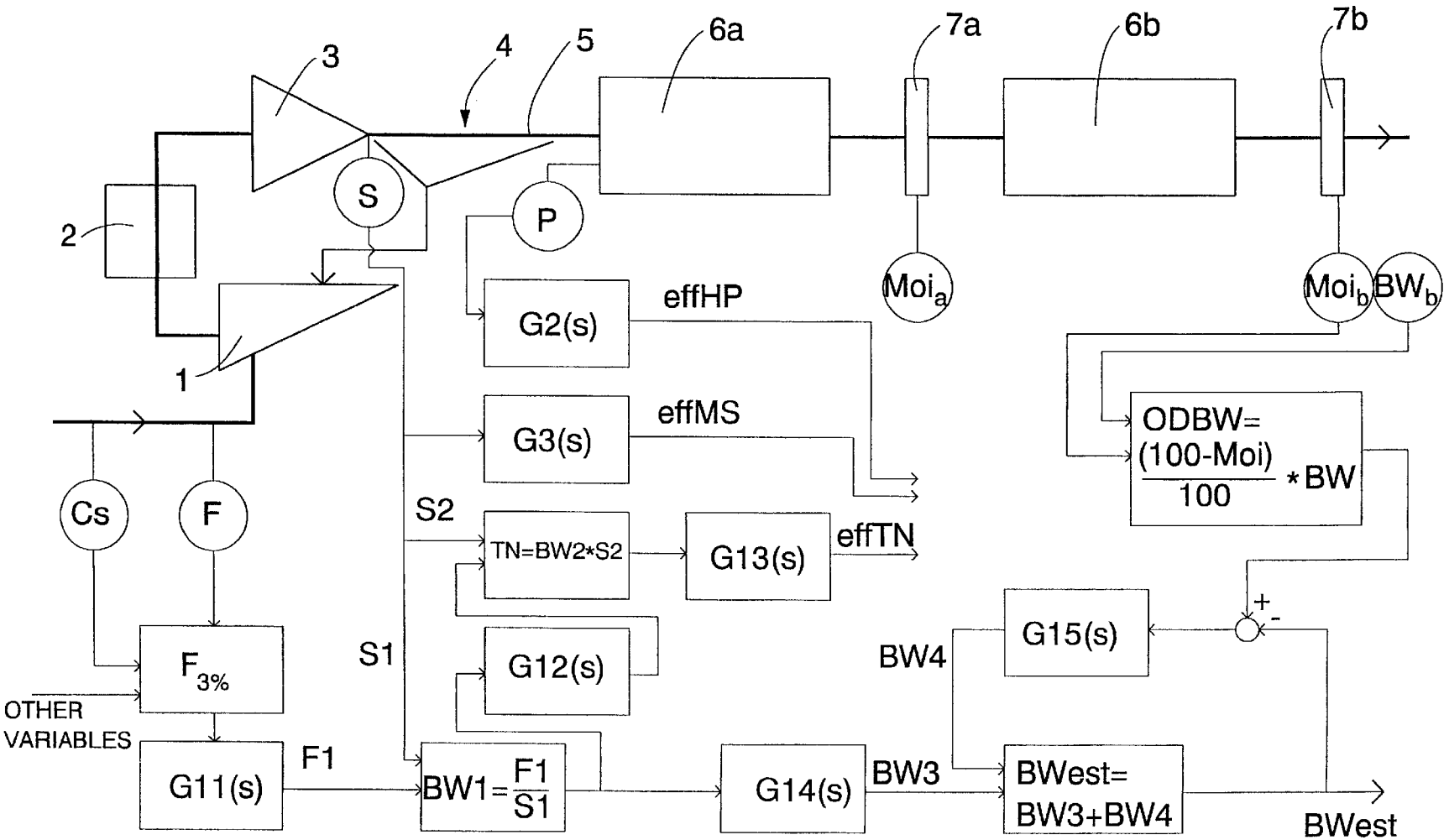
FIG. 2 is a schematic diagram of a grade change model according to the invention for predicting the basis weight.

The basis weight is estimated by means of the grade change model shown in FIG. 2, wherein effective basis weight BW3 is calculated by means of transfer function G14(s) from the calculated basis weight on the lip BW1, used for modelling the moisture. Transfer function G14(s) is usually as shown in equation 4, wherein the dead time represents the combined dead time of the machine and the basis weight measurement, and process gain K takes into account the change caused in the basis weight by both the stretching of the web and its shrinkage due to drying.

Oven-dry basis weight ODBW is calculated from the measured moisture Moi and the basis weight BW in a simple manner for example by means of equation 6

$$ODBW = \frac{(100 - Moi)}{100} \times BW. \quad (6)$$

Transfer function G15(s) is used to calculate the effective basis weight correction BW4.

The input of transfer function G15(s) is the deviation ODBW-BWest.

Transfer function G15(s) is also an integrator, which means that it is as shown in equation 5 and it corrects mainly the calibration errors of the measurements and the errors caused in the mass balance of the process by constituents removed from or added to the process. The basis weight to be estimated BWest is calculated in a simple manner $$BWest = BW + BW4.$$

Figure 3:
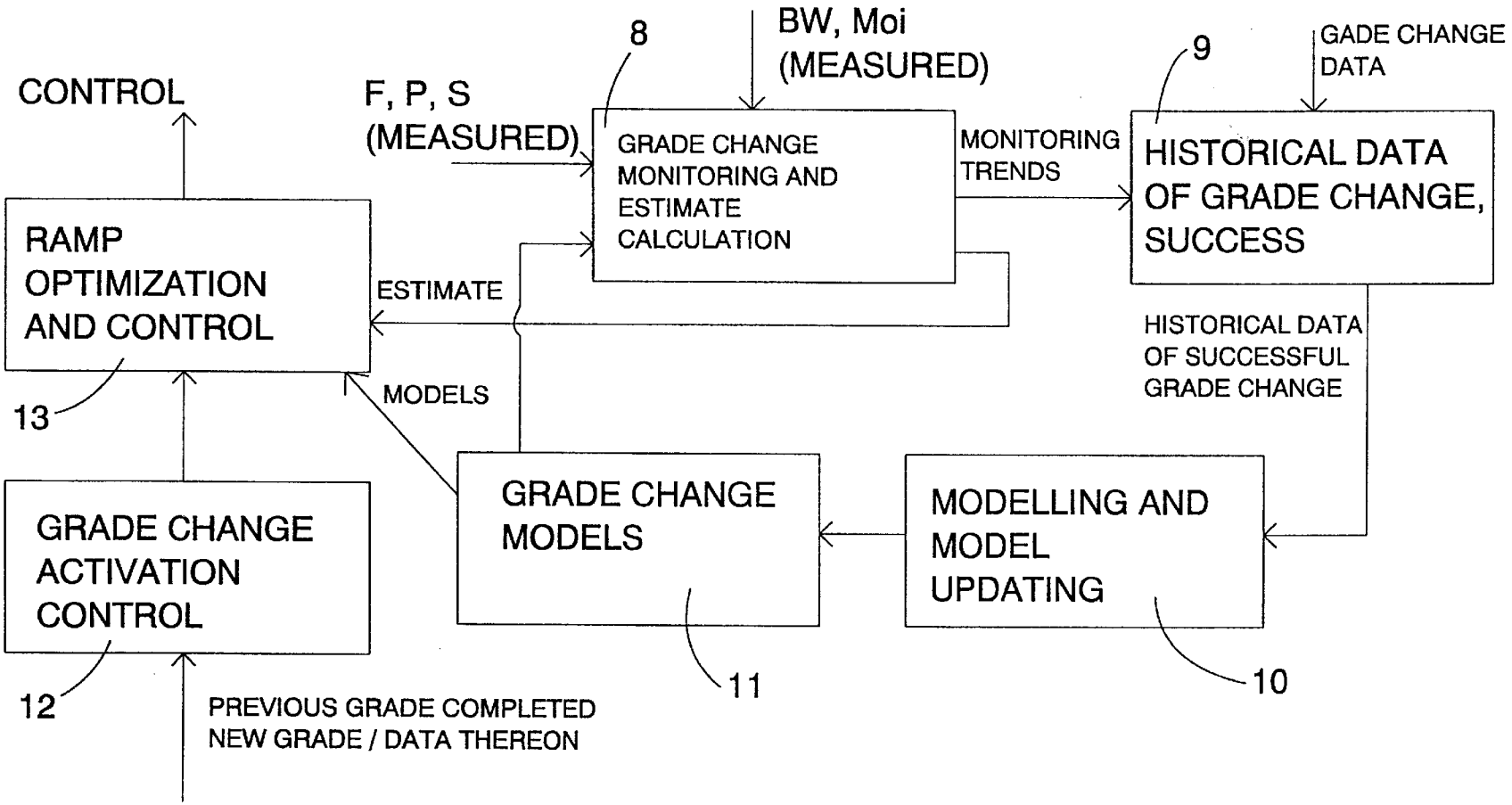
FIG. 3 is a schematic diagram according to the invention of utilizing grade change models in grade changes.

FIG. 3 shows the use of grade change models in grade changes.

In block 8, estimates are calculated for the basis weight BWest and the moisture Moi%est from the ramps scheduled before the ramp activation by using the effective press moisture K4 in modelling the moisture and the effective basis weight correction BW4 in modelling the basis weight. After the ramping has started, the system uses both ramps that have proved to be useful in the past and ramps that have not yet come true and that are used to estimate the future. The development of the effective press moisture K4 and the effective basis weight correction BW4 are also monitored throughout the grade change.

In block 9, if no correction measures were required during the grade change (which data is obtained from block 13), the grade change is declared successful and the data and trends concerning the grade change are stored in a database for successful grade changes. If reramping was required, the grade change is stored in a database for reramped grade changes. The operator acknowledges a grade change to be completed when the key variables of the process are within the new limits. If the grade change has not been acknowledged to be completed after the ramping is over and the quality controls are switched on, the grade change has not been successful.

Block 10 comprises the modelling and updating of grade change models. The grade change models shown in FIGS. 1 and 2 can be recalculated with a known modelling method either at regular intervals or for example when the operating point of the paper machine has changed, i.e. for example when the machine speed has become substantially faster than before. The modelling may be complete or only some variables may be modelled. These variables are typically process gains K1, K2 and K3 in the moisture model.

Modelling is usually started by sorting the material to be modelled according to the changes that have been made and the operating point used. The material to be modelled typically includes only the grade changes stored in the database for successful grade changes.

The database of block 11 contains the grade change models required, their parameters and the data concerning the areas of operation. The starting point in these grade change models is the area of operation of the old grade and the grade change model is defined more accurately according to the change from the old grade to the new grade.

Block 12 describes the activation and control of a grade change. When a predetermined time of running the old grade is left, typically about 30 minutes, preparation for a grade change is started. At this point the old grade, the new grade and other data concerning the new grade are available. Block 13 comprises calculating, by means of the models of FIGS. 1 and 2, ramps that may be for example as shown in FIG. 4.

Figure 4:
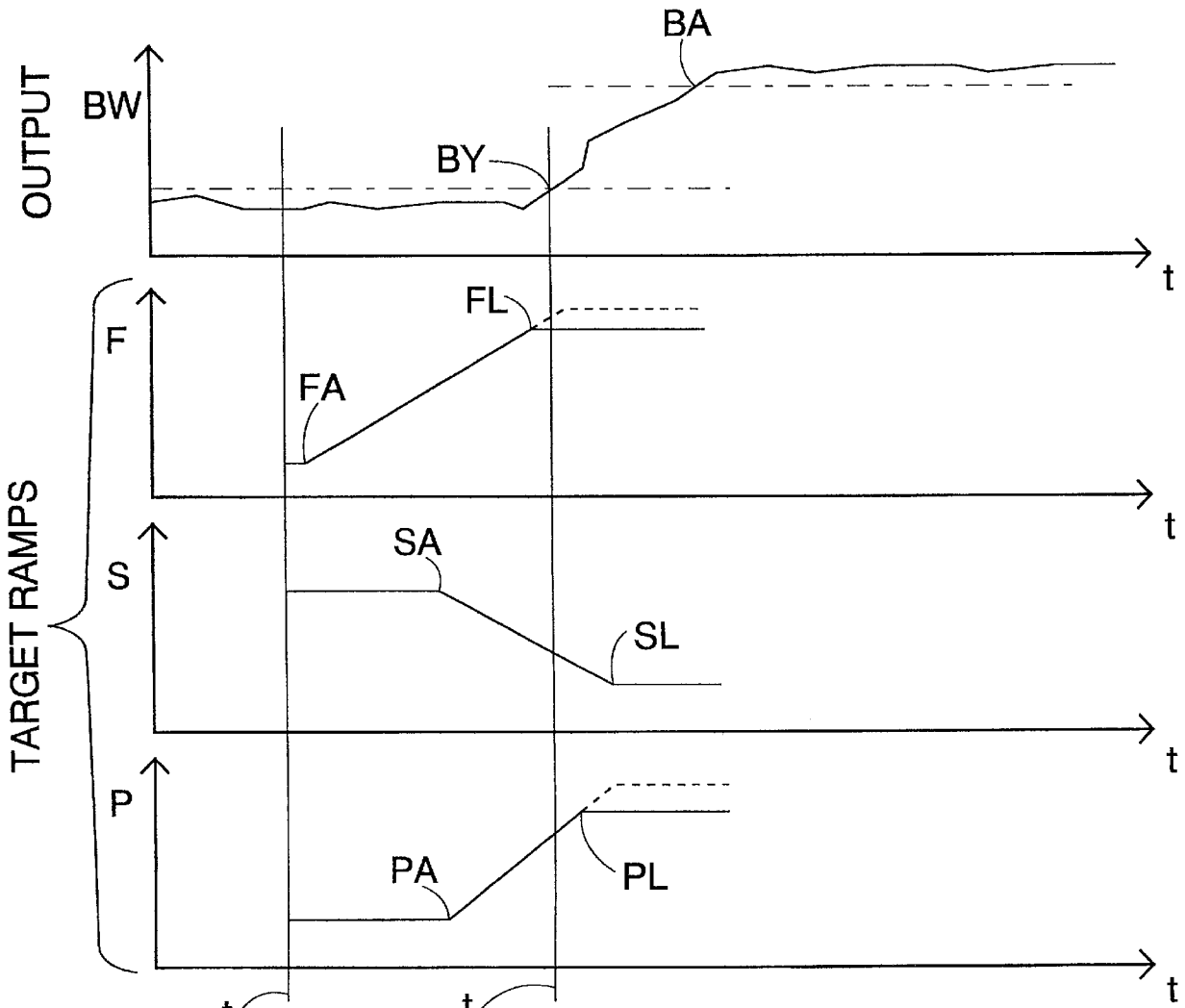
FIG. 4 shows examples of target ramps.

In FIG. 4, the upper chart shows schematically, as a function of time t, the basis weight BW obtained as output. The three lower charts describe different target ramps similarly as a function of time t. The uppermost of the target ramps is the ramp for the stock flow F, the middle one is the ramp for the machine speed S and the lowest one is the ramp for the steam pressure P.

In the chart showing the basis weight BW, the lower dot-and-dash line describes the upper limit of the old target value for the basis weight BW and the upper dot-and-dash line describes the lower limit for the new target value. The old grade is produced until moment $t_2$, namely until the basis weight BW exceeds the upper limit of the old target value, which occurs in point BY. The new grade is produced after point BA, where the basis weight BW has exceeded the lower limit for the new target value. The ramping is activated from moment $t_1$.

The ramps can be calculated by optimizing the transition points that is, starting and ending points of the ramps by using as a cost function the period of time during which the basis weight is not within the desired range, which means the interval from BY to BA, and the moisture difference signal from the desired given value. The moisture difference signal refers to the difference of the moisture target value and the moisture estimated by the grade change model from the desired moisture value. The transition points of the ramp for the stock flow are described by FA and FL, the transition points of the ramp for the machine speed by SA and SL and the transition points of the ramp for the steam pressure by PA and PL. The cost function of the moisture difference message may be non-linear and it may also depend on the point of operation. This is to stress the importance of avoiding the risk of breaks during a grade change.

The ramps can also be determined in the following manner, for example:

1) The moment of activating the ramping is typically a few minutes before the previous grade run is completed. This moment is determined by the grade change moment.
2) The moments of activating the ramping for the stock flow, the machine speed and the steam pressure FA, SA, PA are delayed in a predetermined manner. This delaying has been determined either through simulation or process tests.
3) The greatest allowed rate of change has been determined for each variable. This rate of change may be different during ramping in different directions. Typically, for example when the steam pressure P is increased, the rate of ramping is higher than when the steam pressure P is decreased.
4) The change in the machine speed S is calculated from the grade data.

5) The change in the stock flow F is calculated by means of the static process gains of the grade change model shown in FIG. 2.

6) The change in the steam pressure P is calculated by means of the static process gains of the grade change model shown in FIG. 1.

7) The final moments of the ramps FL, SL and PL are calculated and if the changes are exceptional, some velocities of ramping might have to be decreased so that the ramps would be ready within the predetermined time limits.

The propagation of the ramps is monitored and particularly the development of the effective press moisture K4 and the effective basis weight correction BW4 are observed. If the variation in these two variables is found too great during a grade change or if the estimated basis weight BWest or the estimated moisture Moi%est do not stay within the desired window of change, it is possible to activate recalculation, which means that the final points of the ramps are recalculated. Such ramps remodelled at the end of the ramping are shown, by way of example, by broken lines in FIG. 4. Such recalculation can be submitted to the operator for approval or it may also be executed immediately. If the raramping has been carried out, this data is taken into account in block 9 shown in FIG. 3.

The drawings and the related description are only intended to illustrate the inventive idea. The details of the invention may vary within the scope of the claims. In the drawings, the blocks containing the transfer functions and the formulas also describe the calculating means utilizing these transfer functions and formulas in the calculation.

What is claimed is:

1. A method for executing a grade change in a paper machine, the method comprising determining target ramps in advance for controlled variables of the process, which are ramped according to said target ramps during the grade change, collecting data about the grade changes already executed and thereafter determining grade change models by selecting the data about successful grade changes, the grade change models describing the dynamic behavior of the process during the grade change, and determining the target ramps by means of the grade change models.

2. A method according to claim 1, wherein the grade change model comprises estimating the moisture (Moi%est) during a grade change by means of the formula $$Moi\text{est}=K1*effTN+K3*effHP+K4,$$

wherein effTN is the effective production rate, effHP is the effective steam pressure, K4 is the effective press moisture and process gains K1 and K3 are modelled by means of successful grade changes.

3. A method according to claim 2, wherein the effective machine speed (effMS) that has been multiplied by process gain K2 modelled from the successful grade changes is taken into account in estimating the moisture (Moi%est).

4. A method according to claim 1, further comprising using linear ramps for controlling the variables.

5. A method according to claim 1, wherein the step of determining the grade change model comprises estimating the basis weight (BWest) during the grade change with the formula $$BWest=BW3+BW4,$$

wherein

BW3 is the effective basis weight and

BW4 is the effective basis weight correction.

6. An apparatus for executing a grade change in a paper machine, the apparatus comprising control means that contain target ramps, which have been defined in advance for the controlled variables of the process and according to which the variables are ramped during the grade change, wherein the target ramps supplied to the control means have been determined by means of grade change models defined on the basis of successful grade changes, the grade change models describing the dynamic behavior of the process during the grade change.

7. An apparatus according to claim 6, wherein the control means comprise calculating means for calculating the moisture (Moi%est) included in a grade change model, such that $$Moi\text{est}=K1*effTN+K3*effHP+K4,$$

wherein effTN is the effective production rate, effHP is the effective steam pressure, K4 is the effective press moisture and process gains K1 and K3 are determined by means of successful grade changes.

8. An apparatus according to claim 7, wherein the calculating means comprise means for taking into account the effective machine speed (effMS), multiplied by process gain K2, in calculating the moisture (Moi%est), process gain K2 being modelled by means of successful grade changes.

9. An apparatus according to claim 6, wherein the control means comprise calculating means for calculating the basis weight BWest included in a grade change model, such that $$BWest=BW3+BW4,$$

wherein

BW3 is the effective basis weight and

BW4 is the effective basis weight correction.

* * * * *

UNITED STATES PATENT AND TRADEMARK OFFICE

CERTIFICATE OF CORRECTION

PATENT NO. : 6,473,670 B1
DATED : Octber 29, 2002
INVENTOR(S) : Huhtelin

It is certified that error appears in the above-identified patent and that said Letters Patent is hereby corrected as shown below:

Title page,
Item [74], *Attorney, Agent or Firm*, cancel the comma (,) in the firm name.

Column 7,
Line 30, in the equation, "BWest = BW+BW4" should read -- BWest = BW3+BW4 --.

Column 9,
Lines 47-49, in the formula, after "Moi" insert -- % --, close space to make formula one line.

Column 10,
Lines 31-34, in the formula, after "Moi" insert -- % --, close space to make formula one line.

Signed and Sealed this

Eleventh Day of March, 2003

JAMES E. ROGAN
*Director of the United States Patent and Trademark Office*